US005175042A

United States Patent [19]

Chomarat

[11] Patent Number: 5,175,042

[45] Date of Patent: Dec. 29, 1992

[54] MULTILAYER TEXTILE COMPOSITES BASED ON FIBROUS SHEETS HAVING DIFFERENT CHARACTERISTICS

[75] Inventor: Gilbert Chomarat, Les Gets, France

[73] Assignee: Establissements les Fils d'Auguste Chomarat et Cie, France

[21] Appl. No.: 537,928

[22] Filed: Jun. 13, 1990

[30] Foreign Application Priority Data

Jun. 16, 1989 [FR] France ..... 89 08299

[51] Int. Cl.[5] ..... B32B 3/10

[52] U.S. Cl. ..... 428/139; 428/131; 428/137; 428/138; 428/284; 428/285; 428/287; 428/299; 428/443; 28/104

[58] Field of Search ..... 418/284, 285, 300, 299, 418/287, 131, 137, 138, 139, 443; 28/104

[56] References Cited

U.S. PATENT DOCUMENTS 3,975,565 8/1976 Kendall ..... 428/300
4,522,876 6/1985 Hiers ..... 428/300
4,743,495 5/1988 Liloni et al. ..... 428/300
4,749,613 6/1988 Yamada et al. ..... 428/300
4,755,423 7/1988 Greiser et al. ..... 428/300
4,948,649 8/1990 Hiers et al. ..... 428/300

FOREIGN PATENT DOCUMENTS 0176847 4/1986 European Pat. Off. .

*Primary Examiner*—James J. Bell
*Attorney, Agent, or Firm*—Parkhurst, Wendel & Rossi

[57] ABSTRACT

Textile composite comprising at least two superposed nonwoven fibrous sheets (1, 2), Sheet (2) based on flexible synthetic fibers and the other sheet (1) based on inorganic fibers. Bonding of the sheets is obtained by means of a minor part (2a) of the synthetic fibers which are implanted into the thickness of the sheet (1).

In the sheet (1), the fibers are oriented substantially parallel to the surface and form a relatively dense assembly, the sheet (1) being subjected, before its combination with the sheet (2), to a treatment producing fine perforations in its thickness, inside which perforations are preferably implanted the synthetic fibers (2a) which bond the sheets (1, 2) together.

5 Claims, 1 Drawing Sheet

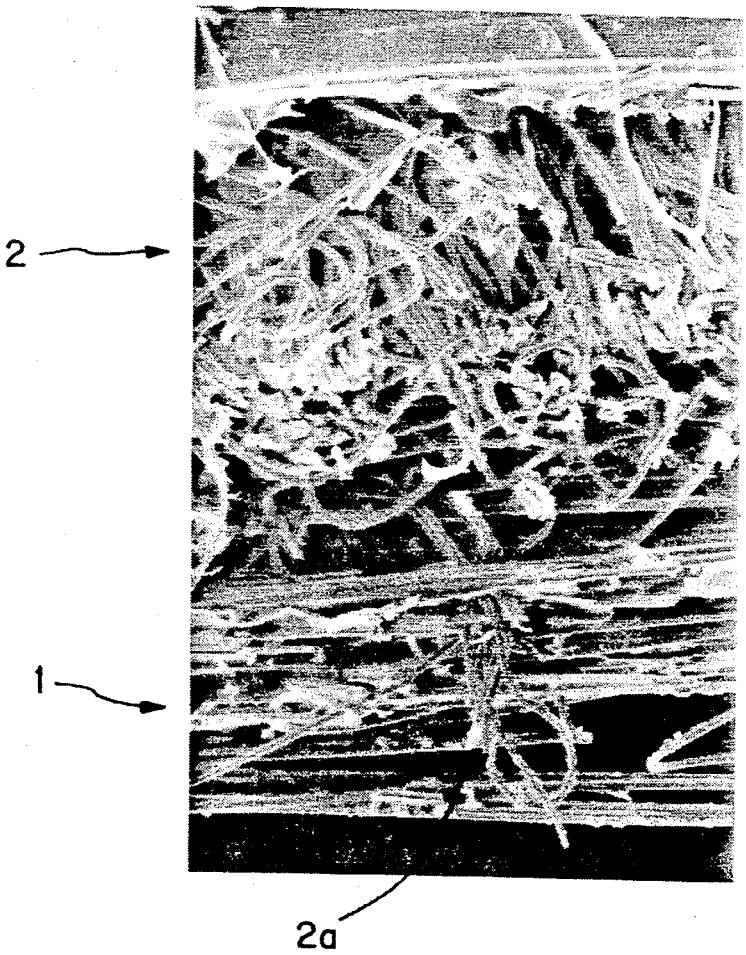
2
1
2a

MULTILAYER TEXTILE COMPOSITES BASED ON FIBROUS SHEETS HAVING DIFFERENT CHARACTERISTICS

The present invention relates to an improvement made to multilayer textile composites based on fibrous sheets having different characteristics forming the subject of U.S. application Ser. No. 07/259,698 filed on Oct. 18, 1988 (corresponding to French Patent 2,622,604 or European Patent 0,315,553); it also relates to an improved process enabling such composites to be obtained.

The abovementioned application describes multilayer textile composites based on fibrous sheets having different characteristics, the sheets being bonded together by entangling of the fibers of one of the sheets through the second. According to this document, one of the sheets forming part of the composition of the composite is based on synthetic fibers (for example polyester), the other sheet being based on relatively stiff and brittle inorganic fibers (glass, asbestos), and the bonding of the sheets to each other is obtained by virtue of a minor proportion of synthetic fibers which are implanted in the thickness of the sheet based on inorganic fibers.

In the case where a composite of this kind is produced from fibrous sheets obtained by a dry route (for example by carding/lapping), a process is employed which consists in superposing the sheets and subjecting them to the action of jets of fluid acting on a sheet superposed on the surface of the sheet based on synthetic fibers, so as to reorient part of these fibers in the direction of the thickness, the stacking being supported, when the jets are in action, by a permeable continuous surface preventing the synthetic fibers from emerging outside the surface of the sheet based on inorganic fibers.

A process of this kind is wholly satisfactory when the various layers of material are based on fibrous sheets obtained by a dry route, that is to say when the fibers of the various sheets are randomly oriented (i.e., having a relatively open combined texture.) However, when the sheets based on inorganic fibers are obtained by techniques such that practically all the elementary fibers are arranged in the same plane (for example sheets obtained by a wet route according to papermaking techniques), then it has been difficult to obtain a good distribution of the synthetic fibers within the sheet based on inorganic fibers and the mutual bonding of the various layers.

Now, it has been found, and this is what forms the subject of the present invention, that it was possible to overcome these disadvantages and to obtain a new type of composite by employing as a fibrous sheet based on inorganic fibers a sheet which has previously undergone a treatment enabling fine perforations to be made throughout its thickness, the combination with the sheet based on synthetic fibers being subsequently effected in accordance with the process described in U.S. patent application Ser. No. 07/259,698 (corresponding to French Patent 2,622,604).

Generally, therefore, the invention relates to a multilayer textile composite of the type comprising at least two superposed nonwoven fibrous sheets:

one of the sheets being based on nonbrittle flexible, synthetic fibers such as polyester, polyamide or polypropylene fibers, the other sheet being based on relatively stiff and brittle inorganic fibers (such as glass, asbestos, etc), the bonding between the two layers being obtained by means of a minor part of the synthetic fibers which are implanted into the thickness of the sheet based on inorganic fibers, without projecting at the surface, and its essential feature is that the fibers are oriented substantially parallel to the surface in the sheet based on inorganic fibers and form a relatively dense assembly, the sheet being subjected, before its combination with the sheet based on synthetic fibers, to a treatment producing fine perforations into its thickness, inside which perforations are preferably implanted the synthetic fibers used to bond the two sheets together.

Naturally, as in the abovementioned U.S. application a composite of this kind may optionally comprise an internal strengthening reinforcement such as a textile (woven or nonwoven) grid, a fabric, a sheet of foam or a felt, etc.

With regard to the characteristics of the perforations which the sheet based on inorganic fibers must have, the dimensions of the perforations must be such that they permit the implantation of a part of the synthetic fibers and are therefore a function of the count of the latter. In general, the perforations which have a diameter from 0.1 mm to 1 mm are suitable for most of the applications.

Furthermore, the sheets based on inorganic fibers employed for making the new product in accordance with the invention will be, for example, a sheet based on glass fibers which is obtained by a wet route according to papermaking techniques.

However, the invention and the advantages which it provides will be understood better by virtue of the comparative examples given below by way of guidance but without any limitation being implied, and of the attached single FIGURE which is a photograph in cross-section of a product made in accordance with the invention.

EXAMPLE 1

A multilayer textile composite based on fibrous sheets is produced in accordance with the teachings of U.S. Ser. No. 07/259698 from elementary sheets which have the following characteristics:

in the case of the fibrous sheet based on flexible synthetic fibers, a polyester voile obtained by cording from 6.6 dtex, 50 mm staple fibers weighing 150 g/m$^2$, with a mean thickness of 5 mm;

in the case of the sheet based on inorganic fibers, a sheet obtained by a wet route (papermaking technique) from glass fibers, weighing 50 g/m$^2$, the fibers being 50 mm staple with a diameter of 14 microns, the sheet having a mean thickness of 2 mm.

These two superposed sheets are brought inside a plant for treatment using jets of fluid, so that the sheet based on polyester fibers is situated facing the jets of fluid.

After calendering, at the exit of the plant, a composite is obtained which has a thickness of approximately one millimeter and whose two faces are constituted in different ways. It is found, however, that the bonding between the two layers is not homogeneous, and this can be explained by the density of the sheet based on glass fibers which are obtained by a wet route, which opposes the implantation of the polyester fibers in the direction of its thickness.

EXAMPLE 2

In accordance with the invention, starting with the same fibrous sheets as in Example 1, before the superposition of the said sheets and their treatment by means of jets of fluid, the sheet based on glass fibers is subjected to a needling treatment forming in the thickness of said sheet microperforations which are spaced at uniform distances from each other. The superposed sheets are then treated in the same way as in Example 1.

At the exit of the plant, a composite constituted as previously of two fibrous sheets which are perfectly bonded to each other is obtained, but the bonding between the two layers is much more homogeneous, the polyester fibers which enter inside the glass sheet being uniformly distributed through the latter and preferably running through the microperforations.

The attached single FIGURE is a good illustration of the structure and the characteristics of a composite material produced in accordance with the invention, the lower region of this FIGURE, given reference (1), consisting of glass fibers which, as can be clearly seen from this photograph, are oriented substantially parallel to the surface of the material, while the region (2), in its case, consists of polyester fibers, some of which fibers (2*a*) are implanted inside the layer (1) based on glass fibers. In this cross-section, microperforations produced in the glass sheet cannot be seen, but correspond substantially to the region through which the fibers (2*a*) of the sheet (2) run perpendicularly across the fibers of the sheet (1).

A material of this kind can be employed in many fields of application, for example as a support for bitumen, allowing leakproofing coatings to be produced.

Naturally, as in the patent mentioned in the preamble, it is possible to incorporate between the two sheets any additional element such as a textile grid, fabric, foam, etc.

In a composite of this kind, the properties of each of the layers are conserved, and this is particularly advantageous when it is desired to have properties which differ between the two surfaces, for example to obtain a fireproof face and the other face insulating.

What is claimed is:

1. A multilayer textile composite comprising:

a first fibrous sheet of non-woven flexible synthetic fibers, said fibers being substantially randomly arranged with respect to each other;

a second fibrous sheet of non-woven, relatively stiff and brittle inorganic fibers, said inorganic fibers being substantially parallel with respect to each other and arranged substantially perpendicular to a thickness direction of said second fibrous sheet, said second fibrous sheet including fine perforations disposed in said thickness direction, said first and second fibrous sheets being superposed such that a portion of said synthetic fibers from said first non-woven sheet are implanted into said fine perforations of said second fibrous sheet, thereby bonding said first and second fibrous sheets together.

2. The composite of claim 1, wherein said fine perforations are 0.1–1.0 mm in diameter.

3. The composite of claim 1, wherein said synthetic fibers are selected from the group consisting of polyester, polyamide or polypropylene fibers.

4. The composite of claim 1, wherein said inorganic fibers are selected from the group consisting of glass and asbestos fibers.

5. The composite of claim 1, further comprising a reinforcement layer disposed between said first and second fibrous sheets.

* * * * *